US005266442A

United States Patent [19]

Ooms

[11] Patent Number: 5,266,442

[45] Date of Patent: Nov. 30, 1993

[54] METHOD FOR INCREASING THE CONTRAST OF PHOTOGRAPHIC SILVER IMAGES

[75] Inventor: Richard A. Ooms, Hofsta de, Belgium

[73] Assignee: Agfa-Gevaert N.V., Mortsel, Belgium

[21] Appl. No.: 808,644

[22] Filed: Dec. 17, 1991

[30] Foreign Application Priority Data

Jan. 15, 1991 [EP] European Pat. Off. ..... 91200064

[51] Int. Cl.[5] ..... G03C 5/29

[52] U.S. Cl. ..... 430/265; 430/268; 430/435; 430/436; 430/438; 430/478; 430/481; 430/482; 430/564; 430/603; 430/604; 430/605

[58] Field of Search ..... 430/265, 268, 435, 436, 430/438, 440, 442, 478, 480, 481, 482, 483, 542, 564, 599, 603, 604, 605

[56] References Cited

U.S. PATENT DOCUMENTS

| | | | |
|---|---|---|---|
| 4,175,966 | 11/1979 | Fujiwhara et al. | 430/438 |
| 4,269,929 | 5/1981 | Nothnagle | 430/438 |
| 4,693,965 | 9/1987 | Ihama et al. | 430/605 |
| 4,833,064 | 5/1989 | Okutsu et al. | 430/438 |
| 4,965,169 | 10/1990 | Hirano et al. | 430/438 |
| 5,009,992 | 4/1991 | Friedrich et al. | 430/572 |
| 5,061,614 | 10/1991 | Takada et al. | 430/607 |
| 5,079,138 | 1/1992 | Takada | 430/607 |

*Primary Examiner*—Hoa Van Le
*Attorney, Agent, or Firm*—William J. Daniel

[57] ABSTRACT

A method for the production of a silver image with improved contrast by the development of an image-wise exposed photographic silver halide emulsion layer material with a developer liquid containing a hydroquinone in the presence of an auxiliary developing agent, wherein said developer liquid is applied to said photographic material containing silver halide grains that have been chemically sensitized with organic thiosulphonic acid anions in combination with a gold sensitizer in the absence of thiosulphate ions.

15 Claims, No Drawings

METHOD FOR INCREASING THE CONTRAST OF PHOTOGRAPHIC SILVER IMAGES

FIELD OF THE INVENTION

The present invention relates to a photographic silver halide emulsion layer material suitable for high contrast development.

BACKGROUND OF THE INVENTION

In the reproduction of continuous tone information for mechanical printing purposes, it is customary to make a half-tone photographic intermediate, usually a film negative, in which the gradations in tone are represented by dots of differing size. The quality of the resulting halftone picture is closely connected with the shape, spectral density, and, uniformity of the dots of the half-tone print.

In order to obtain very high-contrast screen dots in halftone images it has been practice to formulate developers, so-called lith-developers, containing essentially a p-dihydroxybenzene such as hydroquinone, an alkali, an alkali metal bromide and a low level of free sulfite ions.

Very high contrast results, preferably with gamma above 10, also called "lith-gradation", can be obtained with said high-contrast developers and so-called "lith silver halide emulsion materials". In these materials the silver halide comprises at least 50 mole % of chloride, the balance, if any, being bromide and optionally a minor amount of iodide.

Hydroquinone developers having a low sulfite ion concentration are commonly referred to as "lith-type developers" and their mechanism of operation has been described for the first time by J. A. C. Yule in the Journal of the Franklin Institute, 239 (1945), pages 221 to 230.

The properties of lith-type developers are believed to result from autocatalytic action, often called "infectious development", due to a local high concentration of the oxidation products of the developing agent, which can build up as a result of the low sulfite ion concentration that has to be kept at low level to maintain the lith-development characteristic. This is achieved in all known commercial developers of this type by the use of the addition product of formaldehyde and sodium hydrogen sulfite, i.e. sodium formaldehyde hydrogen sulfite, which acts as a sulfite ion buffer.

Convential "lith" developers suffer from deficiencies which restrict their usefulness. For example, the developer exhibits low development capacity as a result of the fact that it contains hydroquinone as the sole developing agent. Also, the aldehyde tends to react with the hydroquinone to cause undesirable changes in development activity. Furthermore, the low sulfite ion concentration is inadequate to provide effective protection against aerial oxidation. As a result, a conventional "lith" developer is lacking in stability and tends to give erratic results depending on the length of time that it has been exposed to air.

With the advent of processing machines and more particularly, rapid access processing machines, the deficiencies of lithographic processing chemistry became serious and apparent. Developer degradation was accelerated under machine processing conditions. The lag in the start of development caused by the long induction period of the hydroquinone developers lengthened the processing time and delayed access to the finished product.

As explained e.g. in U.S. Pat. No. 4,081,280 a lith-developer with low free sulfite content has to be replenished carefully for compensating for developer exhaustion by aerial oxidation.

By using so-called "rapid-access" developers containing both hydroquinone and an auxiliary developing agent, e.g. a 1-phenyl-3-pyrazolidinone type developing agent or N-methyl-p-aminophenol sulphate, the induction period can be eliminated and the developing process speeded up.

Developer liquids containing a fairly high amount of sulfite and hydroquinone in combination with an auxiliary developing agent are more stable with respect to oxidation by oxygen of the air than developers having a relatively low sulfite content and containing hydroquinone as the sole developing agent. However, the trouble is that rapid access developers containing said auxiliary developing agents are not suited for use in linework or halftone image production because they cannot produce the necessary high gradient. Thus, the combination of combine high contrast development with the processing convenience and stability of the rapid access developers remains a goal in this field.

It is generally known that the sensitometric properties (e.g. speed and/or gradient) of a photographic silver halide emulsion material can be controlled by the silver halide emulsion preparation, e.g. by the silver halide grain size, its distribution and chemical sensitization of the silver halide grains. Sulphur sensitization is the most widely used method of conferring speed and contrast on a silver halide emulsion [ref. Photographic Emulsion Chemistry by G. F. Duffin—The Focal Press—London and New York (1966), p. 84].

SUMMARY OF THE INVENTION

It is an object of the present invention to provide a method of effecting high contrast development with a developer containing a hydroquinone in the presence of an auxiliary developing agent by the use of a photographic silver halide emulsion layer material chemically sensitized so that a contrast enhancement is achieved.

Further objects and advantages of the present invention will appear from the following description and examples.

The present invention provides a method for the production of a silver image with improved contrast by development of an image-wise exposed photographic silver halide emulsion layer material with a developer liquid containing a hydroquinone in the presence of an auxiliary developing agent, wherein said developer liquid is applied to said photographic material containing silver halide grains that have been chemically sensitized with organic thiosulphonic acid anions in combination with a gold sensitizer in the absence of thiosulphate ions.

The present invention more particularly provides in a method for the development of an image-wise exposed photographic silver halide emulsion layer material, wherein the development is effected in an aqueous developer liquid medium which has a pH of 10 to 12 and which contains:

a)

(i) a hydroquinone developing agent, (ii) at least one auxiliary developing agent that provides to the developer liquid a higher developing activity (shorter developing time for same developed image density) compared with a same developer but wherein the hydroquinone developing agent is used as sole developing agent in a molar amount being the same as the total molar amount of the combined developing agents, b) free sulfite ions in an amount of at least 5 grams per liter, the use of a photographic material of which the silver halide grains have been chemically sensitized in the absence of thiosulphate ions but with organic thiosulfonic acid anions in combination with a gold sensitizer, and the use of said developing agents mentioned under (i) and (ii) in said development of said image-wise exposed photographic material in such amounts that if a latent continuous tone wedge image were developed therewith the density versus log exposure sensitometric curve of the resulting silver wedge image would have a maximum gradient ($\gamma$) of at least 8.0 between the log exposure values measured at densities of 0.3 and 3.0 above fog on the log exposure scale and would have a gradient ($\gamma_v$) of at least 3.0 in the toe between the log exposure values measured at densities of 0.1 and 0.6 above fog on the log exposure scale.

DETAILED DESCRIPTION OF THE INVENTION

The anions of said organic thiosulfonic acid are provided by a compound corresponding to the following general formula:

$$R—SO_2—S^-.Me^+$$

wherein:

R represents an aliphatic, aromatic or heterocyclic group including said groups in substituted form, e.g. a methyl or p-tolyl group, and $Me^+$ represents a metal cation, organic cation or hydronium, preferably alkali metal cation or onium group.

p-Toluenethiosulfonic acid potassium and sodium salts which are commercially available are preferred. These can be prepared according to Beil. 11, 114.

Methylthiosulfonic acid can be prepared as described by J. O. Macke and L. Field in J. Org. Chem. 53, 396 (1988).

A preferred amount of organic thiosulfonic acid anions applied in the chemical sensitization is in the ratio range of $5.10^{-5}$ to $5.10^{-2}$ mole per mole of silver halide.

Gold sensitization may proceed with any gold compound providing free gold ions. Particularly good results are obtained with $HAuCl_4$, and with alkali metal aurothiocyanate formed by the combined use of an alkali metal thiocyanate and gold chloride. Free thiocyanate ions may be present in the chemical ripening stage.

A preferred amount of gold sensitizer applied in the chemical sensitization is in the ratio range of $1.10^{-4}$ to $5.10^{-1}$ g per mol of silver halide.

The presence of sulfite ions during the chemical ripening stage has no deleterious effect on contrast enhancement, on the contrary.

Hydroquinone compounds that may be used according to the present invention include unsubstituted hydroquinone and substituted hydroquinones e.g.:

chlorohydroquinone,
bromohydroquinone,
isopropylhydroquinone,
toluhydroquinone,
methylhydroquinone,
2,3-dichlorohydroquinone,
2,5-dimethylhydroquinone,
2,3-dibromohydroquinone,
1,4-dihydroxy-2-acetophenone-2,5-dimethylhydroquinone,
2,5-diethylhydroquinone,
2,5-di-p-phenethylhydroquinone,
2,5-dibenzoylaminohydroquinone, or
2,5-diacetaminohydroquinone and mixtures thereof.

The preparation of these hydroquinone compounds is known to those skilled in the art.

The concentration of hydroquinone type developing agent in the developer liquid is preferably in the range of 5 to 50 g per liter of developer.

The hydroquinone and the auxiliary developing agents according to (ii) are used preferably in a molar ratio in the range of 10/1 to 1000/1.

Suitable auxiliary developing agents belong to the class of p-aminophenol type developing agents, 1-phenyl-3-pyrazolidinone type developing agents, p-phenylenediamine type developing agents and hydrazine type developing agents.

Examples of suitable auxiliary developing agents are listed in the following Table 1.

TABLE 1

| Auxiliary developing agent |
|---|
| 1. p-phenylene diamine sulphate |
| 2. 1-p-carboxyphenyl-4,4-dimethyl-3-pyrazolidinone |
| 3. N,N-diethyl-p-phenylene diamine hydrochloride |
| 4. p-amino-phenol |
| 5. N,N-diethyl-N'-ethyl-N'-4-sulphobutyl-p-phenylene diamine hydrochloride |
| 6. N-2-hydroxyethyl-N-methyl-p-aminophenol hydrochloride |
| 7. 1-m-chlorophenyl-4,4-dimethyl-3-pyrazolidinone |
| 8. N,N-diethyl-N'-hydroxyethyl-p-phenylene diamine dihydrochloride |
| 9. N,N-diethyl-N',N'-dihydroxyethyl-p-phenylene diamine dihydrochloride |
| 10. N-methyl-p-aminophenol sulphate |
| 11. 1-phenyl-4,4-dimethyl-3-pyrazolidione |
| 12. 1-phenyl-3-pyrazolidinone |
| 13. ascorbic acid |
| 14. hydrazine |
| 15. phenylhydrazine hydrochloride |
| 16. p-(Beta-methylsulfonamidoethyl) phenylhydrazine sulfate |

Further examples of developing agents that can be combined with hydroquinone can be found in Modern Photographic Processing by G. Haist, Vol. I - Wiley and Sons - New York, (1979), p. 170–198.

A preferred combination of developing agents is the combination of hydroquinone with 1-phenyl-3-pyrazolidinone or with 1-phenyl-4,4-dimethyl-3-pyrazolidinone.

A part or the whole amount of the developing agent(s) may be present in the photographic material, e.g. in a silver halide photographic emulsion layer or in a layer in water-permeable relationship therewith. In case the developing agents are incorporated in full in the photographic material the development may be carried out by contacting the photographic material with an alkaline aqueous liquid free from developing agent(s) but containing the necessary alkali and sulfite ions.

According to a preferred embodiment in the process of the present invention an aqueous alkaline developer composition is used that has a pH between 10.5 and 12.

The sulfite ions are incorporated into the developer composition starting preferably from an alkaline metal hydrogen bisulfite or metabisulfite or a corresponding ammonium salt. The concentration of free sulfite ion is preferably in the range of 15 to 80 grams per liter.

The developer may contain watersoluble polyoxyalkylene compounds in the range of 0.01 g to 10 g per liter of developer composition.

The polyoxyalkylene compounds may be present in the photographic material, e.g. in the silver halide emulsion layer and/or in a layer in waterpermeable relationship therewith.

Other adjuvants well known to those skilled in the art of developer formulation may be added to the developer to perform various functions intended.

A survey of conventional developer addenda is given in the already mentioned book of "Modern Photographic Processing" - Vol. I, p. 220–274. Such addenda are e.g. restrainers, such as the soluble halides, e.g. applied as potassium bromide, organic solvents improving the solubility of developing agents, preservatives, e.g. biocides and puffering agents, e.g. carbonates, phosphates and borates.

The developer used according to the present invention may contain organic solvent(s) for the developing agents and/or antifogging agents.

Organic solvent(s) for hydroquinone and/or 1-phenyl-3-pyrazolidinone type developing agents are described e.g. in U.S. Pat. No. 4,030,920, GB-P 1,343,718 and FR-P 71.41095 (publication No. 2,114,785). Suitable solvents for use according to the present invention are watermiscible solvents of the class of amides, alcohols, organic diol compounds and half-ethers thereof.

The developer formulation may be prepared in a concentrated form and diluted to a working strength just prior to use. Concentrated solutions for automatic processing are widely used in processing machines operating with a replenishment system. The developer may be kept in two parts before use and combined and diluted to the desired strength with water. Thus, the auxiliary developing agent(s) may be kept in acid medium in one part and the other ingredients in alkaline medium in the other part.

Developer solutions used according to the present invention can be left in a machine processor for several weeks without marked degradation and replenishment proceeds simply by adding a fresh amount of developer after discarding an exhausted portion.

Useful photographic silver halide emulsion elements for processing according to the present invention are silver chloride emulsion elements as conventionally employed in forming "lith" photographic elements as well as silver bromide and silverbromoiodide emulsion elements which are capable of attaining higher photographic speeds. Preferably silver halide emulsion elements are used in which the silver halide grains comprise at least 50 mole % of chloride, more preferably at least 70 mole % of silver chloride, the balance, if any, being bromide. The silver halide may also contain a small amount of iodide, e.g. less than 5 mole %, if desired.

The photographic silver halide emulsions can be prepared by mixing the halide and silver solutions in partially or fully controlled conditions of temperature, concentrations, sequence of addition, and rates of addition. The silver halide can be precipitated according to the single-jet method, the double-jet method, or the conversion method.

The silver halide particles of the photographic emulsions used according to the present invention may have a regular crystalline form such as a cubic or octahedral form or they may have a transition form. They may also have an irregular crystalline form such as a spherical form or a tabular form, or may otherwise have a composite crystal form comprising a mixture of said regular and irregular crystalline forms.

The silver halide grains may have a multilayered grain structure. According to a simple embodiment the grains may comprise a core and a shell, which may have different halide compositions and/or may have undergone different modifications such as the addition of dopes. Besides having a differently composed core and shell the silver halide grains may also comprise different phases inbetween.

Two or more types of silver halide emulsions that have been prepared differently can be mixed for forming a photographic emulsion for use in accordance with the present invention.

The size distribution of the silver halide particles of the photographic emulsions to be used according to the present invention can be homodisperse or heterodisperse. A homodisperse size distribution is obtained when 95% of the grains have a size that does not deviate more than 30% from the average grain size.

In addition to silver halide the emulsions may also comprise organic silver salts such as e.g. silver benzotriazolate and silver behenate.

In addition to the defined chemical sensitizing agents the silver halide crystals can be doped with salts or complexes of metals of group VIII of the periodic table of elements, e.g. $Rh^{3+}$ and $Ir^{4+}$, further $Cd^{2+}$, $Zn^{2+}$, $Pd^{2+}$; $Pb^{2+}$, ions of Ru, Re or Os or mixtures thereof. Preferably used are $Rh^{3+}$ and/or $Ir^{4+}$ ions.

Other possible chemical sensitizing agents are salts or complexes of Pb, Hg, Tl, Pd or Pt or a combination thereof.

The photographic emulsions can be prepared from soluble silver salts and soluble halides according to different methods as described e.g. by P. Glafkidès in "Chimie et Physique Photographique", Paul Montel, Paris (1967), by G. F. Duffin in "Photographic emulsion Chemistry", The Focal Press, London (1966), and by V. L. Zelikman et al in "Making and Coating Photographic Emulsion", The Focal Press, London (1966).

The emulsion can be desalted in the usual ways e.g. by dialysis, by flocculation and re-dispersing, or by ultrafiltration.

The chemical sensitization or ripening preferably proceeds at elevated temperature, e.g. in the range of 40° to 60° C., by mixing the chemical sensitizing agents with the redispersed silver halide grains in the presence of gelatin as protective colloid. The pH of the dispersion medium is e.g. in the range of 5 to 6.

The light-sensitive silver halide emulsions can be spectrally sensitized (ortho-, pan- or infra-red sensitized) with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, homopolar cyanine dyes, hemicyanine dyes, styryl dyes and hemioxonol dyes. Particularly valuable dyes are those belonging to the class of cyanine dyes, merocyanine dyes and complex merocyanine dyes.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. No. 2,933,390 and U.S. Pat. No. 3,635,721, aromatic organic acid/formaldehyde condensation products as described e.g. in U.S. Pat. No. 3,742,510, cadmium salts, N and azaindene compounds.

The silver halide emulsion for use in accordance with the present invention may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroindazoles, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75-39537, and GB-A 1,500,278, and 7-hydroxy-s-triazolo-[1,5-a]-pyrimidines as described in U.S. Pat. No. 4,727,017, and other compounds such as benzenethiosulphinic acid and benzenethiosulphonic acid amide. Other compounds that can be used as fog-inhibiting compounds are metal salts such as e.g. mercury or cadmium salts and the compounds described in Research Disclosure No. 17643 (1978), Chapter VI.

The fog-inhibiting agents or stabilizers can be added to the silver halide emulsion prior to, during, or after the chemical sensitization thereof and mixtures of two or more of these compounds can be used.

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g. higher contrast, sensitization, and development acceleration.

The photographic element of the present invention may further comprise various other additives such as e.g. compounds improving the dimensional stability of the photographic element, UV-absorbers, spacing agents, hardeners, and plasticizers.

Suitable additives for improving the dimensional stability of the photographic element are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth)acrylates, and styrene sulphonic acids.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

A silver halide emulsion layer material according to the present invention may contain any hydrophilic water-permeable binding agent not impairing the photographic properties. Suitable hydrophilic binder materials include gelatin, colloidal albumin, polyvinyl compounds, cellulose derivatives, acrylamide polymers, colloidal hydrated silica, etc. Mixtures of these binding agents may be used. These binding agents may be used in admixture with dispersed (latex-type) vinyl polymers. Such compounds are disclosed in e.g. the U.S. Pat. Nos. 3,142,568 of Robert William Nottorf, issued Jul. 28, 1964, 3,193,386 of Clayton F. A. White, issued Jul. 6, 1965, 3,062,674 of Robert Wong, issued Nov. 6, 1962, 3,220,844 of Robert C. Houck, Donald A. Smith and Joseph S. Yudelson, issued Nov. 30, 1965. They include the water-insoluble polymers of alkyl acrylates and methacrylates, acrylic acid, sulfoalkyl acrylates or methacrylates, copolymers of alkyl acrylates with acrylic acids, acryloyl-oxyalkyl sulphonic acids, acetoacetoxy alkyl acrylates such as 2-acetoacetoxyethyl methacrylate and the like. These compounds may be incorporated likewise into a layer separate from the silver halide emulsion layer of the photographic element. The vinyl polymers are generally employed in concentrations of about 20 to about 80%, most often concentrations of at least 50% by weight, based on the weight of the binding agent.

A silver halide emulsion material according to the present invention may also contain conventional addenda such as plasticizers, coating aids and hardeners, e.g. aldehyde hardeners such as formaldehyde, mucochloric acid, glutardialdehyde and maleic dialdehyde, aziridines, oxypolysaccharides, dimethylurea, hydroxychlorotriazine, divinyl sulphones and/or triacrylformal.

According to an embodiment of the present invention the photographic material comprises a support having thereon at least one silver halide emulsion layer containing gelatin as principal binder for the silver halide, wherein the ratio by weight of gelatin to silver halide expressed as an equivalent amount of silver nitrate, said ratio being called GEZI hereinafter) is in the range of 1 to 0.05, preferably for improved contrast results between 0.35 and 0.05.

For graphic art applications the coverage of silver halide expressed in the form of an equivalent amount of silver nitrate per $m^2$ is preferably in the range of 2 to 10 $g/m^2$, and the average diameter of the silver halide is preferably in the range of 0.05 to 0.4 μm.

In film type photographic materials, i.e. materials wherein the support is transparent the silver halide coverage expressed as an equivalent amount of silver nitrate per $m^2$ is preferably in the range of 4 to 7 g per $m^2$, whereas for silver halide emulsion materials having an opaque support, e.g. polyethylene coated paper support, the silver halide coverage is preferably equivalent with a silver nitrate coverage of 1 to 4 g per $m^2$.

By the presence of considerably less gelatin binding agent than in common silver halide emulsion layer materials much thinner layers can be coated having less tendency to swell. Thinner layers having a higher silver halide concentration provide a shorter way to processing solution ingredients for their interaction with the silver halide grains than is the case with silver halide emulsion layers rich in gelatin whereby they become highly swollen on aqueous processing.

The production of silver halide emulsion layers with relatively high silver halide packing density due to the presence of less binding agent than is commonly encountered is in favour of the production of images with high "covering power" (CP). By "covering power" is understood the ratio of diffuse optical density (D) to the number of grams of developed silver per $dm^2$. Silver halide emulsion layers offering a high covering power can be coated at smaller silver halide coverage which makes the production of silver halide photographic materials less expensive because therein the silver content is a dominating economic feature.

An important advantage of photographic silver halide emulsion materials having a GEZI in the range of 0.35 to 0.05 is their property to yield particularly contrasty images when developed in the rapid access developers defined above. Such is proved by a considerable raise in gamma infinity as is shown in a comparative example furtheron.

The possibility to obtain a high gamma infinity (above 8) makes said photographic materials particularly suited for halftone reproduction (sharp screen dot reproduction) and such with said rapid access developers without having the disadvantages of lith-development.

In common halftone image production the exposure of a lith-film proceeds in a process camera to a continuous tone original and through a contact screen. Due to light-straying a somewhat bell-shaped screen dot profile is obtained. The slope of the edges of that profile is steepened by lith-development.

However, by the introduction of the laser a rapidly and digitally modulatable light source became available providing a very thin light beam by means of which screen dots can be generated with a much steeper density profile than up till now was possible by the use of contact screens (ref. Der Polygraph 4–74 "Elektronisches Rastern von Farbauszügen" by Dr.-Ing. Uwe Gast-Teil 1, p. 196 and Laser+Elektro-Optik Nr.2/1980-Printing with Laser, by Charles Christinat, p. 22–24). The production of screen dots with steeper density profile by digitally modulated laser beam exposure makes it possible to use less contrasty operating developers than developers based on infectious development for a same or almost same dot quality in the halftone image as is obtained by the use of contact screen exposure in halftone image production combined with infectious development.

For contrasty screen dot production the present photographic material is advantageously combined with laser beam screen dot generation and rapid access development wherein the applied rapid access developers provide much more convenience in their preparation and storage, require less replenishment for there is less oxidation by air and can be used in much more concentrated form.

The silver halide emulsion(s) of the high-contrast photographic materials according to the present invention may be coated in a single layer or multiple layer system on a wide variety of supports. If desired they are coated on both sides of the support.

Typical supports are cellulose nitrate film, cellulose ester film, polyvinyl acetal film, polystyrene film, poly(ethylene terephthalate) film, and related films or resinous materials, as well as glass, paper, metal and the like. Supports such as paper, which are coated with Alpha-olefin polymers, particularly polymers of Alpha-olefins containing two or more carbon atoms, as exemplified by polyethylene, polypropylene, ethylene-butene copolymers and the like may be employed likewise.

In processing photographic elements according to the present invention, the time and temperature employed for development can be varied widely. Typically, the development temperature will be in the range of from about 20° C. to about 50° C., while the development time in rapid access normally no longer lasts than 90 s.

Further information on photographic silver halide emulsions, preparations, addenda, processing and systems can be found in Research Disclosure December 1989, item 308119.

The photographic silver halide emulsions chemically sensitized as described above can be used in various applications. Preferably they are used in photographic materials for the graphic arts. They can be used in negative as well as in or direct positive type photographic materials, but likewise in diffusion transfer reversal (DTR) photographic elements, in low-speed, e.g. room light insensitive photographic elements, high-speed photographic elements such as radiographic films used in combination with X-ray fluoresent intensifying screens and laser beam sensitive films sensitive e.g. to He-Ne gas laser beam or semi-conductor solid state laser beams of relatively low energy.

The following examples illustrate the invention. All parts and percentages are by weight unless mentioned otherwise.

COMPARATIVE EXAMPLES 1 to 7

A fine grain (average grain size 0.30 μm) silver chlorobromo-iodide (83.6/16/0.4 mol %) emulsion containing 0.1 ppm rhodium per mol of silver was coated onto a subbed polyethylene terephtalate support at a gelatin coverage of 3.6 g per sq.m. and a coverage of silver halide equivalent with 7.22 g of silver nitrate per sq.m (GEZI: 0.498).

The emulsion was chemically sensitized as is indicated in Table 2, stabilized with 4-hydroxy-6-methyl-(1,3,3a-7)-tetrazaindene and spectrally sensitized to green light.

The silver halide emulsion layer was coated with a protective layer containing formaldehyde-hardened gelatin at a coverage of 1 g of gelatin per sq.m.

Samples of the film prepared as described above were exposed in a vertical camera REPROMASTER RPS 2001 (trade name) through a continuous tone wedge having a wedge constant 0.15.

The exposed samples were processed in a rapid access developer (see composition hereinafter) for 30" at 35° C. by using a RAPILINE 66 (trade name) developing apparatus.

After development the samples were fixed, washed and dried in the same developing apparatus.

In said Table 2 the photographic speed of the materials according to examples (Ex.) No. 1 to 7 is expressed in relative sensitivity values (r.S) measured at density 3.0 above fog. The speed obtained with the material of Ex. No. 1 is arbitrarily given the value 100.

Gradient values in the toe ($\gamma_v$) of the sensitometric curve were measured between the log exposure values at densities 0.1 and 0.6 above fog on the log exposure scale of the sensitrometric curve. Straight line gradient (maximum gradient) values ($\gamma$) were measured between the log exposure values at densities 0.3 and 3.0 above fog on the log exposure scale of the sensitometric curve.

TABLE 2

| Ex. No. | $Na_2S_2O_3$ g/mole silver | $H(AuCl_4)$ g/mole silver | $NH_4SCN$ g/mole silver | $R—SO_2—SNa$ g/mole silver | $Na_2SO_3$ g/mole silver | Fog | r · S | $\lambda_v$ | $\lambda$ |
|---|---|---|---|---|---|---|---|---|---|
| 1 | $3.4 \times 10^{-3}$ | $6.1 \times 10^{-3}$ | $12.2 \times 10^{-3}$ | $17.0 \times 10^{-3}$ | $8.5 \times 10^{-3}$ | 0.03 | 100 | 2.7 | 8.1 |
| 2 | nil | " | " | 0.340 | " | 0.05 | 114 | 4.3 | 12.9 |
| 3 | nil | nil | nil | 0.340 | " | 0.36 | 81 | 3.7 | 8.5 |
| 4 | nil | nil | nil | 0.340 | nil | 0.21 | 83 | 4.6 | 9.8 |
| 5 | nil | $6.1 \times 10^{-3}$ | nil | 0.340 | $8.5 \times 10^{-3}$ | 0.04 | 114 | 4.2 | 13.2 |
| 6 | nil | " | $12.2 \times 10^{-3}$ | 0.340 | nil | 0.04 | 91 | 5.2 | 12.7 |
| 7 | nil | $12.2 \times 10^{-3}$ | $24.4 \times 10^{-3}$ | 0.340 | $8.5 \times 10^{-3}$ | 0.03 | 95 | 4.9 | 13.3 |

R = p-tolyl

Chemical sensitization conditions: 4 h at 50° C. - pH 5.2; pAg 120 mV

It is apparent from Table 2 that photographic emulsions which are chemically sensitized with p-toluenethiosulphonic acid sodium salt in the absence of $Na_2S_2O_3$ offer an improved contrast as compared to photographic emulsions which are chemically ripened with additional $Na_2S_2O_3$.

The applied developer had the following composition:

| | |
|---|---|
| ethylenediamine tetra-acetic acid sodium salt | 1 g |
| potassium carbonate | 25 g |
| potassium sulfite | 65 g |
| potassium bromide | 10 g |
| 2-methoxy-ethanol | 20 ml |
| 1-phenyl-3-pyrazolidinone | 300 mg |
| hydroquinone | 20 g |
| 1-phenyl-5-mercaptotetrazole | 30 mg |
| water up to | 1 l |
| pH adjusted to 10.50 with potassium hydroxide. | |

EXAMPLE 8

The material of Example 8 was the same as that of Example 2 with the difference however that the gelatin coverage in the silver halide emulsion layer was only 2.1 g per sq.m to correspond with a GEZI: 0.29.

The obtained $\gamma_v$ and maximum gradient value $\gamma$ were 4.6 and 13.7 respectively proving a contrast enhancement by lowering the GEZI value.

I claim:

1. A method for the production of a photographic silver image of increased contrast by the photographic development of a photographic silver halide emulsion layer material which comprises the steps of imagewise exposing to light a silver halide emulsion layer material containing silver halide grains that have been chemically sensitized with a combination of organic thiosulfonic acid anions and a gold sensitizing agent in the absence of thiosulfate ions, and developing the thus-exposed emulsion layer material with a photographic developer liquid containing a hydroquinone developing agent in the presence of an auxiliary developing agent to form said silver image.

2. A method according to claim 1, wherein said organic thiosulfonic acid anions are p-tolylthiosulfonic acid anions.

3. A method according to claim 1, wherein the amount said organic thiosulfonic acid anions is in the chemical sensitization in the ratio range of $5.10^{-5}$ to $5.10^{-2}$ mole per mole of silver halide.

4. The method of claim 1 wherein said gold sensitizing agent is $HAuCl_4$ or a combination of an alkali metal thiocyanate and gold chloride.

5. A method according to claim 1, wherein the amount of the gold sensitizing agent is in the ratio range of $1.10^{-4}$ to $5.10^{-1}$ g per mole of silver halide.

6. A method according to claim 1, wherein the chemical sensitization is carried out in the presence of thiocyanate ions.

7. A method according to claim 1, wherein the chemical sensitization is carried out in the presence of sulfite ions.

8. A method according to claim 1, wherein the silver halide grains of the photographic material comprise at least 50 mole % of chloride.

9. A method according to claim 1, wherein the silver halide emulsion layer contains gelatin as principal binding agent for the silver halide and the ratio by weight of gelatin to silver halide expressed as an equivalent amount of silver nitrate is in the range of 0.35 to 0.05.

10. The method of claim 1, wherein the developing step is effected in an aqueous developer medium which has a Ph of 10 to 13 and which contains:

a)
(i) a hydroquinone developing agent,
(ii) at least one auxiliary developing agent that imparts to the developer medium a higher developing activity compared with the same developer medium containing said hydroquinone developing agent alone in the same molar amount as the total molar amount of the combination of said developing agents (i) and (ii). and b) free sulfite ions in an amount of at least 5 grams per liter, said developing agents (i) and (ii) being used in said developing step in such amounts that if a latent photographic continuous tome wedge image were developed therewith the density versus log exposure sensitometric curve of the resulting silver wedge image would have a maximum gradient ($\gamma$) of at least 8.0 between the log exposure values measured on said curve at densities of 0.3 and 3.0 above fog and would have a gradient ($\gamma$) of at least 3.0 in the toe between the log exposure values measured at densities of 0.3 and 0.6 above fog.

11. A method according to claim 10, wherein the concentration of said hydroquinone developing agent (i) in the developer liquid is in the range of 5 to 50 g per liter of developer.

12. A method according to claim 10, wherein the hydroquinone developing agent and the auxiliary developing agent(s) according to (ii) are used in a molar ratio in the range of 10/1 to 1000/1.

13. A method according to claim 10, wherein said hydroquinone agent is hydroquinone and said auxiliary agent is a 1-phenyl-3-pyrazolidinone type developing agent.

14. A method according to claim 1, wherein said a developer medium container sulfite ions in the range of 15 to 80 grams per liter.

15. A method according to claim 1, wherein the silver image is a halftone image the screen dots of which are generated by digitally modulated laser beam exposure.

* * * * *